United States Patent [19]

Dudley

[11] 4,293,127

[45] Oct. 6, 1981

[54] MONO-KINETIC EXERCISE DEVICE

[75] Inventor: Peter B. Dudley, Los Gatos, Calif.

[73] Assignee: Mono-Kinetics, Los Gatos, Calif.

[21] Appl. No.: 137,809

[22] Filed: Apr. 4, 1980

Related U.S. Application Data

[63] Continuation-in-part of Ser. No. 970,486, Dec. 18, 1978, abandoned.

[51] Int. Cl.[3] ..... A63B 21/00

[52] U.S. Cl. ..... 272/133; 272/143; 272/900

[58] Field of Search ..... 272/133, 131, 143, 130, 272/116, 135, DIG. 3, 132, 900

[56] References Cited

U.S. PATENT DOCUMENTS

| | | | |
|---|---|---|---|
| 439,263 | 10/1890 | Zein et al. | 272/133 X |
| 609,106 | 8/1898 | Lauritsen | 272/133 X |
| 3,411,776 | 11/1968 | Holkesvick et al. | 272/133 |
| 3,451,271 | 6/1969 | Knoblauch | 272/130 X |
| 3,785,644 | 1/1974 | Bradley et al. | 272/DIG. 3 X |
| 4,050,310 | 9/1977 | Keiser | 272/130 X |

*Primary Examiner*—Richard C. Pinkham
*Assistant Examiner*—William R. Browne
*Attorney, Agent, or Firm*—Thomas E. Schatzel

[57] ABSTRACT

A mono-kinetic exercise device for mounting within a doorway or other rectangular aperture. The exercise device includes brackets of various types for attachment of the device to the door frame, tensioning devices, one or more ropes extending lengthwise along the device and a gripping bar grasped by the person desiring exercise which may be moved upward or downward within the doorway such that the movement entails an effort by the exerciser and provides muscle exertion. The gripping bar is moved against frictional resistance that is developed in the interior of the gripping bar.

21 Claims, 16 Drawing Figures

MONO-KINETIC EXERCISE DEVICE

This application is a continuation in part of copending application Ser. No. 970,486 filed Dec. 18, 1978, now abandoned.

BACKGROUND OF THE INVENTION

1. Field of the Invention

The present invention relates generally to exercise devices and more specifically to a mono-kinetic exercise device for mounting in a rectangular frame.

2. Description of the Prior Art

Exercise devices have existed in various forms almost since the beginning of history. They have ranged from a tree limb for doing pullups or chinups to modern medical exercisers and weight machines of incredible complexity.

One of the main means of exercising the body, particularly the arms and legs, is by exerting the muscles to move an object in space against resistance. The most common application of this sort of exercise is in weight lifting, wherein a barbell loaded with the desired amount of weight is lifted and manipulated. Variations on this theme are numerous and include such items as weights attached to pulleys, which are pulled upwards by the use of ropes, and tension bars.

Several of the prior art devices utilize the friction between a rope or other elongated fabric material and a stationary friction surface. Examples of this type of exercising device may be found in U.S. Pat. No. 3,411,776 granted to E. E. Holkesvick, et al.; U.S. Pat. No. 3,460,392 granted to G. F. Kolbell; U.S. Pat. No. 3,462,142 granted to R. F. Sterndale; U.S. Pat. No. 3,506,262 granted to L. R. Wade; U.S. Pat. No. 829,754 granted to C. J. Bailey; and U.S. Pat. No. 3,510,132 granted to E. E. Holkesvick. Each of these devices utilizes the friction between a rope or elongated fabric against a surface to provide the resistance to movement required for proper muscle exertion. In each case the means by which the friction is provided is different and the type of exercise for which the specific device is designed varies.

One of the difficulties with many of the prior art exercise devices is that they require special exercise areas or further equipment for proper functioning. Those devices which are self-contained or easily attached to available surfaces are frequently extremely limited in their applicability.

SUMMARY OF THE INVENTION

It is therefore an object of the present invention to provide an exercise device which may be readily attached to the interior of a door frame or any other pair of substantially parallel members.

It is another object of the present invention to provide an exercise device by which arms and legs may be strengthened by the movement of an exercise bar in a vertical plane against substantial resistance.

It is a further object of the present invention to provide an exercise device by which the amount of resistance to motion of the exercise bar is adjustable.

Briefly, a preferred embodiment of the present invention is an exercise device designed for mounting within an ordinary doorframe or other rectangularly shaped frame. The device includes brackets, fasteners or clamps for mounting to the door frame at points at the bottom and top of both sides of the frame, ropes attached or supported by such brackets and extending in the plane of the frame, a grasping bar mounted on the ropes intermediate the ends of the device, rope friction members in or about the grasping bar and tension members for adjusting the tension on the ropes and thus adjusting the resistance to motion of the grasping bar.

An advantage of the present invention is that it is rugged and inexpensive.

A further advantage of the present invention is that it is easily mounted and removed from an ordinary door frame or similar frame.

Yet another advantage of the present invention is that the easily adjusted tensioning means provides that the tension and the resistance to movement can be tailored for the particular user, and can be gradually increased as the user becomes stronger.

Yet another advantage of the present invention is that the grasping bar remains balanced from side to side regardless of usage.

These and other objects and advantages of the present invention will no doubt become obvious to those of ordinary skill in the art after reading the following detailed description of the preferred embodiment which are illustrated in the several figures of the drawing.

IN THE DRAWING

DETAILED DESCRIPTION OF THE PREFERRED EMBODIMENT

Figure 1:
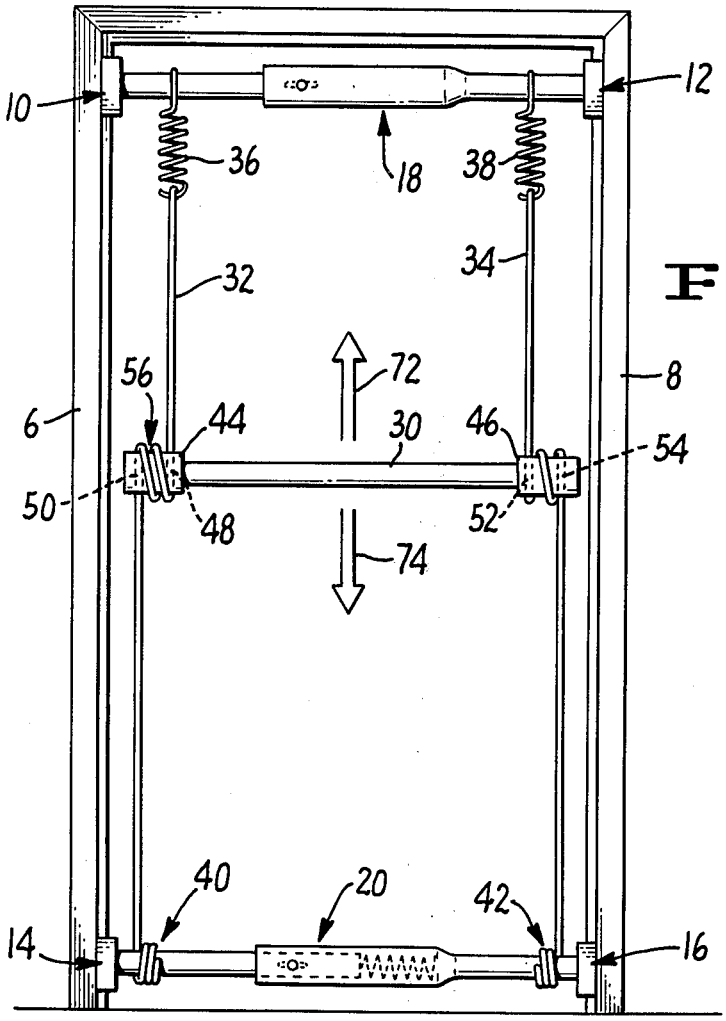
FIG. 1 is a front view of a typical door frame having mounted therein a mono-kinetic exercise device of the present invention.

FIGS. 1–4 illustrate a first embodiment of an exercise device of the present invention referred to by the general reference character 5. In FIG. 1 there is shown a door frame having sides 6 and 8. Near the top of the frame are two mounting brackets, generally designated 10 and 12, while another pair of brackets, designated 14 and 16, are located near the bottom of the frame. The brackets 10 and 14 have detent means, as is hereinafter described in detail, and the brackets 12 and 16 may be provided with detent means but normally are plain brackets without the detents. An upper bar, generally designated 18, is mounted between the brackets 10 and 12 while a lower bar 20 is mounted between the brackets 14 and 16. Each of the bars has an enlarged tube 22 into which a small tube 24 telescopes (See FIG. 2). Bars 24 and 26 are somewhat shorter than the width of a doorway or other support and are normally biased outwardly by means of a spring 28. Thus, either of the bars 20 and 18 can be easily installed merely by compressing the spring in the enlarged portion which results in shortening the bar so it will fit within the brackets and then allowing the spring to expand so that the bar will expand and be held firmly within the brackets. The lower bar 20 is restrained from turning, by means hereinafter specified, while it is immaterial whether the upper bar 18 rotates.

A center bar 30 is provided and this is the bar one grasps for purposes of exercise. This bar is supported on ropes 32 and 34 which are attached to the springs 36 and 38 which are supported on bar 18. The bottom end of the ropes 32 and 34 wrap around bar 20 as is shown in general at 40 and 42 and which later is described in detail.

The bar 30 has hubs 44 and 46 at the terminal ends. The outer surface of each of the hubs is smooth and round, and each hub has two holes passing through the diameter thereof, namely the holes 48 and 50 in the hub 44 and the holes 52 and 54 in the hub 46. Rope 32 passes downwardly through hole 48 and then is wrapped once or more around hub 44, as is shown at 56, and then passes downwardly through hole 50 where it wraps around the bar 20 as is shown at 40. Rope 34 is similarly strung at the opposite end as is clearly shown in FIG. 1.

Figure 4:
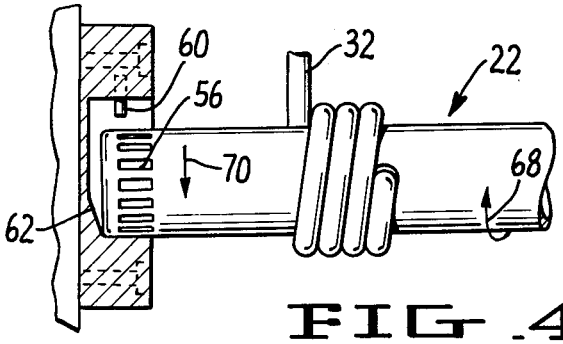
FIG. 4 is a front view of the lower bar portion of the device of FIG. 1 with a portion of the left side bracket cut away to show the method by which the tension on the device may be changed.

As previously mentioned, the bottom ends of the rope 32 and 34 wrap around the bar 20, as is shown at 40 and 42, and the purpose of this is to control the amount of resistance of the exercise device. As is shown best in FIGS. 2 and 4, one end of the roller 22, that is the end composed of the tube 24, has a plurality of slots 56 therein. Bracket 14 has a central opening 58, and at the top of this opening is a detent pin 60 while at the bottom of the opening is a ramp-like portion 62. The bracket itself is held in place by means of mounting screws 64 and 66. If one wishes to change the tension, it is only necessary to push downwardly on bar 22 as is shown in FIG. 4. This disengages the slots 56 from pin 60 so that bar 22 can easily be turned. Thus, if one wishes to increase the tension, one turns the bar in the direction indicated by arrow 68 which winds the rope on the bar 22; while if one wishes to decrease the tension, one rotates the bar in the direction shown by arrow 70 unwrapping the rope 32. Now, when one lets go of the bar, the spring at 28 pushes the member 24 outwardly into engagement with ramp 62 which pushes the bar up so that the detent pin 60 engages one of the slots 56.

It will be apparent that the force necessary to raise the bar in direction 72 is much greater than to return the bar in the direction of the arrow 74. It is obvious that as the bar is raised, one is working against the fixed bar 20; whereas as the bar is lowered, the springs 36 and 38 decrease the effective tension, minimizing the downward drag on the exercise bar. In many instances, it is desired to exercise in both directions in which case the upper bracket 10 is made identical to the lower bracket 14. Thus, it is easy to reverse the position of the support bars 18 and 20 to reverse the exercise direction.

Figure 3:
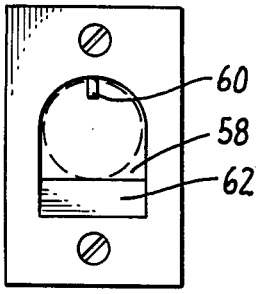
FIG. 3 is a cross-sectional view taken along the line 3—3 of FIG. 2.
Figure 2:
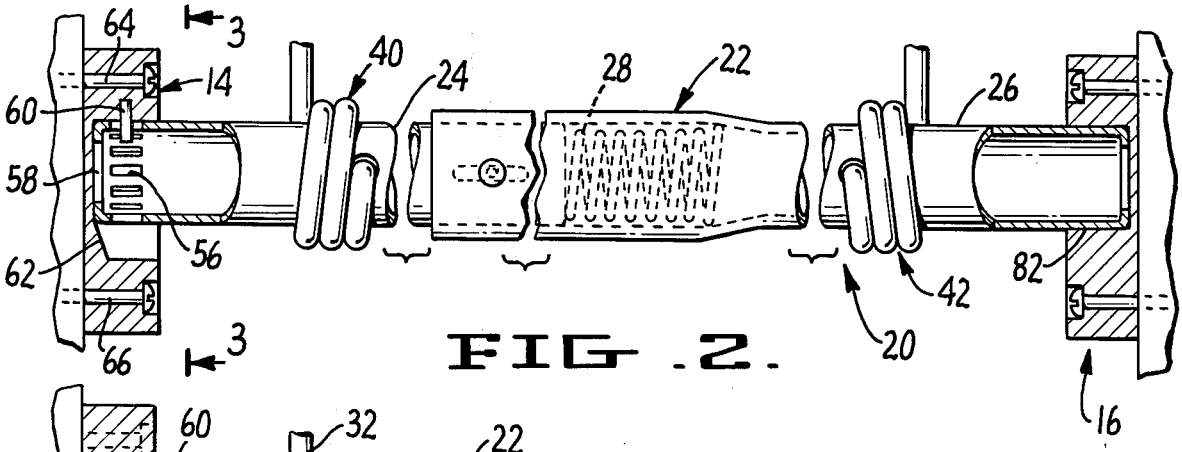
FIG. 2 is an enlarged view, partly in section, of the lower bar portion of the device of FIG. 1 showing particularly the tensioning adjustment.

All four of the support brackets can be the same, although for the purposes of the present invention, it is only essential that one of the brackets be of the structure shown in FIGS. 2, 3 and 4 to lock a bar end, since it is not necessary that the opposite end of the bar be locked or that the upper bar be locked, if it is not required that the exercise direction be reversible. Preferably the brackets 10 and 14 are of the structure shown in FIGS. 2–4 so that the bar can be reversible. The opposite brackets 12 and 16 can be of the structure shown at the right hand side of FIG. 2 wherein the bracket 16 is merely provided with a round, central opening 82 to receive the round bar end 26 and is provided with mounting screws as previously described.

Although a preferred embodiment of the invention has been described, it is obvious that many variations can be made in the exact structure shown without departing from the spirit of this invention.

Figure 5:
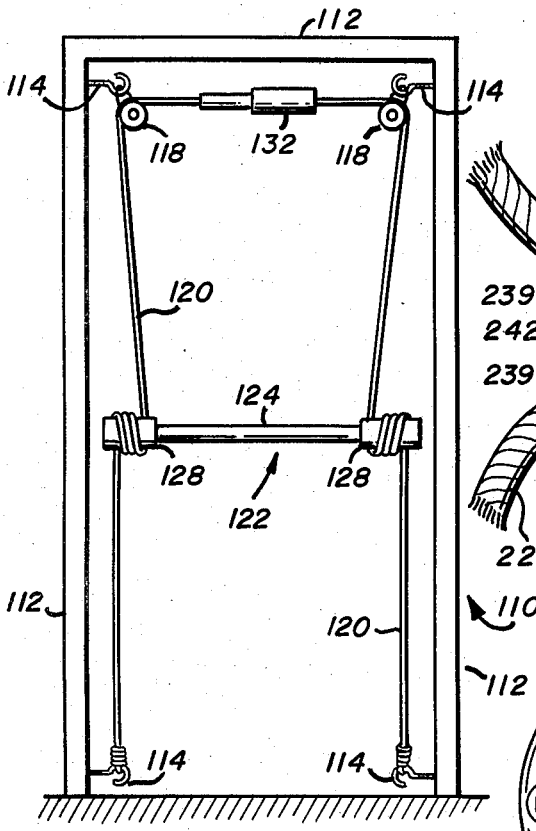
FIG. 5 is a front plan view of a door frame having mounted therein a first alternate embodiment of an exercise device of the present invention.

A first alternate embodiment of an exercise device of the present invention is illustrated in FIG. 5 and referred to by the general reference character 110. The device 110 is also mounted in a door frame 112 or other similarly shaped and supported rectangular frame. Mounted at the corners of the frame are four support hooks 114. The support hooks 114 are firmly mounted to the door frame 112 in a semi-permanent manner such that they can support sufficient weight to allow the exercise device to function properly. Each of the upper support hooks 114 has, in the ordinary orientation, a pulley 118 extending therefrom. Pulleys 118 are adapted for receiving a rope 120. Rope 120 provides the interconnecting element of the exercise device 110.

Rope 120 is firmly attached to the lower support hooks 114 in the ordinary orientation while it is supported at its upper portions by the pulleys 118 which are attached to upper hooks 114. Intermediate the upper and lower portions of the door frame 112 the rope passes through an exercise bar assembly 112.

Exercise bar assembly 122 includes a grasping bar 124 extending across doorway 112 and a pair of hubs 128 situated at the ends of the grasping bar 124. Rope 120 passes through and around hubs 128. The hubs 128 provide the friction element for rope 120 in the same manner as in the embodiment 5.

A feature which causes the embodiment 110 to function differently than that of the embodiment 5 is that the upper ends of rope 120 are connected to a single tension adjuster 132. Tension adjuster 132 operates to vary the amount of tension on rope 120 and consequently varies the amount of friction between rope 120 and hubs 128. Tension adjuster 132 may be any of a number of devices by which the tension may be manually varied. A preferred tension adjuster 132 would be a lockable screw type device for shortening the distance between the ends of the tension adjuster 132. Another method is the use of a vacuum bonded pair of interlocking tubes. The degree of pull upon the ends of rope 120 may be adjusted by the user by adjusting the tubes.

The embodiment 110 includes the advantages that it is much simpler and easier to manufacture than the embodiment 5. The support hooks 114 are readily available inexpensive elements, and the tension adjuster 132 is a much simpler element than the rotating lower bar of the preferred embodiment. Although the embodiment 110 leaves the support hooks 114 mounted within door frame 112 at all times, which may cause some inconvenience, it is very easily and quickly installed and removed from the frame.

A second alternate embodiment of the exercise device is illustrated in FIGS. 6 through 11 and referred to by the general reference character 210.

The embodiment 210 is mounted within a door frame 212 or any other substantially rectangular frame. A number of "T" brackets 214, four in the ordinary case, are mounted on the facing vertical surfaces of frame 212 near the top and bottom portions thereof. The "T" brackets 214 are firmly attached to the frame 212 to anchor the device 210 at the various corners.

At one end of the device 210, in the ordinary orientation the lower end, the "T" brackets 214 have attached thereto a pair of adjustable rope holding members 216. The remaining "T" brackets 214, in the ordinary orientation the upper "T" brackets 214, have attached thereto a pair of pulley brackets 218.

As in the embodiments 5 and 10, the interconnecting element of the exercise device 210 is a rope 220. Rope 220 is attached at its lower ends to adjustable rope holding members 216 and passes at its upper portions through pulleys 218.

Intermediate the upper and lower portions of the device 210 is the exercise bar assembly 222. Exercise bar assembly 222 includes a grasping bar 224 which extends horizontally within frame 212 between the two sides of the frame. Located at each end of grasping bar 224 are a rope guide hub 228 and a collar 230 which serves to guide the rope 220 and to hold the exercise bar assembly 222 together and in proper orientation. It may be noted that in the embodiment 210 the rope 220 passes through the entire exercise bar assembly and in fact passes through the interior of grasping bar 224.

Situated at the upper end of the exercise device 210, and attached to the upper ends of rope 220, is an extension spring 232. Extension spring 232 puts tension upon the upper portions of rope 220 and thus maintains a high degree of friction between the rope 220 and the exercise bar assembly 222. The degree of tension caused by the operation of spring 232 may be varied by tightening the rope 220 by moving adjustable rope holders 216 to lower positions upon "T" brackets 214.

Figure 6:
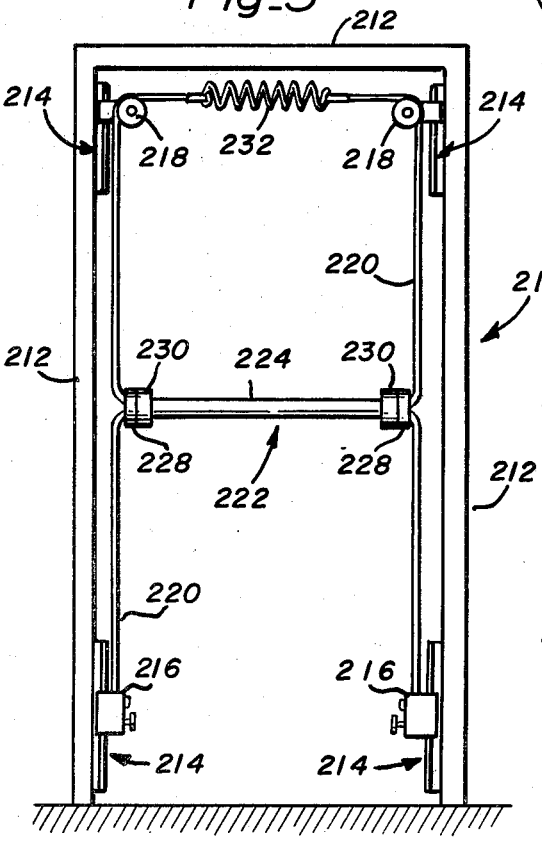
FIG. 6 is a front plan view of a second alternate embodiment or the present invention, having the ropes pass through the exercise bar assembly and providing friction with a friction rod contained therein.

The tension on the ropes provided by spring 232 is important to the operation of the device 210. In the orientation of FIG. 6, the main resistance to motion of the exercise bar assembly 222 is from bottom to top. That is, a greater degree of force is required to move the bar upwards than it does to move it downwards. This is caused by the fact that the tension on the upper portion of rope 220 is maintained to be taut even when bar assembly 222 is being moved upwards towards the spring 232. The tautness of the upper portions of ropes 220 maintains tight friction and thus provides an excellent resistance to movement of the bar assembly 222. Tightening the ropes 220 and stretching extension spring 232 by the downward adjustment of adjuster brackets 216 causes the friction to increase and consequently increases the force necessary to move bar assembly 222 upwards.

When it is desired to return the bar downward, however, the expandability provided by spring 232 and the fact that the lower portion of rope 220 is not maintained in a taut state causes the bar to move downward with considerably less force requirement than is necessary to move it upwards toward spring 232. Practice has shown that the force ratio of this embodiment is about 3:1 from upward to downward.

Since the four "T" brackets 214 are essentially identical and the holding brackets such as the adjustable rope holders 216 and the pulley brackets 218 are both adapted to attach to "T" brackets 214, the device 210 may be reversed such that spring 232 is situated at the bottom of frame 212. In this orientation it will be relatively easy to move the bar assembly 222 upwards, whereas it will be difficult to move it in the downward direction. The varying orientations are useful depending on the type of exercise desired. The orientation illustrated in FIG. 6 is particularly appropriate for exercises such as weight pressing or curling, whereas the reverse orientation would be useful for motions similar to those of a pullup exercise.

Figure 7:
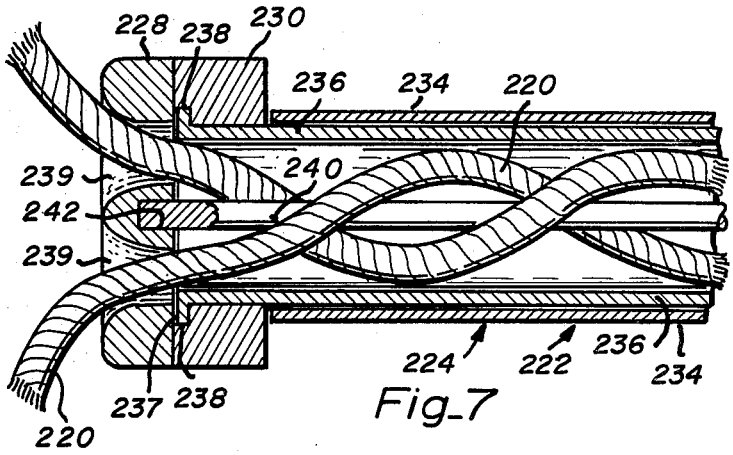
FIG. 7 is a longitudinal cross-sectional view of the exercise bar assembly of the embodiment of FIG. 6.

FIG. 7, which is a cross-sectional view of a portion of the exercise bar assembly 222, illustrates the construction of exercise bar assembly 222 and the interior arrangement thereof. This view shows the manner in which rope 220 interacts with the assembly 222 to provide the necessary friction for the exercise function of the device.

Grasping bar 224 is actually a pair of nested hollow cylinders. The user of the device will actually grasp an outer cylinder 234. The outer cylinder 234 will then freely rotate upon an inner cylinder 236 of slightly lesser diameter. Inner cylinder 236 is firmly held in position by means of a slight circumferential ridge 237 about the end edge. The ridge 237 fits into a depression 238 in the exterior edge of collar 230. The inner cylinder is then held in place by the pressure of rope guide member 228 against collar 230. Exterior cylinder 234 is shorter in length than interior cylinder 236. Thus, the ends of exterior cylinder 236 are positioned so that they are just short of the interior edge of collar 230. Thus, very little horizontal play is available to exterior cylinder 236, although it is free to totally rotate upon interior cylinder 234. This rotation factor is particularly valuable in doing exercises such as the weight lifting technique known as a curl. In such an instance, it is preferable to have the bar turn slightly during the lift to prevent pulling the device 210 out of the vertical planar orientation in which it operates most efficiently.

FIG. 7 also illustrates the manner in which the rope 220 interacts with the exercise bar assembly 222. The rope guide member 228 includes a pair of apertures 239 through the end portion thereof. The rope extends through apertures 239 and then is wrapped a desired number of times about a friction rod 240 which is mounted within the exercise bar assembly 222. Friction rod 240 is tapered at the ends to fit into a seating hole 242 in the rope guide member 228 at each end. Friction rod 240 is totally supported by the rope guide members 228 and does not contact the inner cylinder 234 or the collar 230 at all.

The number of times that rope 220 wraps around friction rod 240 greatly affects the friction involved and the consequent force required to move the exercise bar assembly 222 against the friction force. It is normally found that having the rope intertwine about the friction rod 240 more than four times creates a force requirement that is beyond the normal exercise range.

Figure 8:
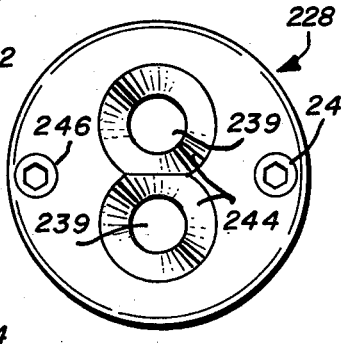
FIG. 8 is an end view of the exercise bar assembly of the embodiment of FIG. 6.
Figure 9:
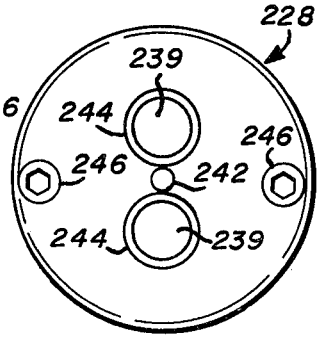
FIG. 9 is an inside view of the rope guide hub of FIG. 8.

FIGS. 8 and 9 are exterior and interior views, respectively, of the rope guide member 228. The two apertures 239 in the rope guide member 228 are arranged such that they are aligned vertically when the rope guide member is installed. In this manner they can effectively receive the rope 220 which will extend from above and below the entire exercise bar assembly 222. In order to minimize the danger of the rope catching on any element in the device and to make the rope guides function effectively, the two apertures 239 are surrounded by a taper 244, both on the outside and on the inside. The taper 244 is much more extensive on the outside surface of rope guide 228 where the angle of the incoming rope is more severely changed at the guide member 228 than it is on the inside, (see FIG. 9), where the angle of the rope entering the guide member 228 is much less. Guide member 228 is held in position by a pair of securing screws 246. Securing screws 246 bond the rope guide member 238 to the collar 230 and thus holds the entire assembly together.

As can be seen especially in FIG. 9, the seating hole 242 for receiving friction rod 240 appears only on the interior surface of the rope guide member 228. The depth of seating hole 242 is such that when the rope guide members 228 on each end are securely fastened to the collars 230 the friction rod 240 will rest within the seating holes 242 of the two rope guides 228 in such a manner as to be relatively snug.

Figure 10:
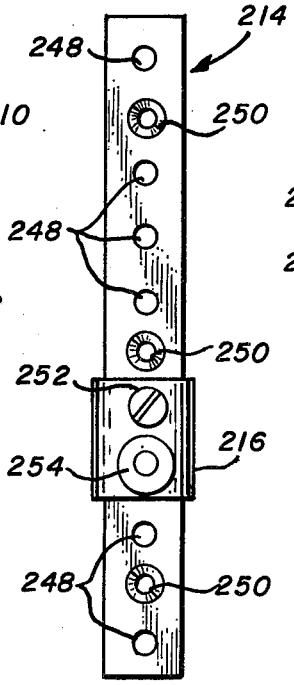
FIG. 10 is a front plan view of the T-bracket and adjustable rope holding member of the second alternate embodiment of FIG. 6.
Figure 12:
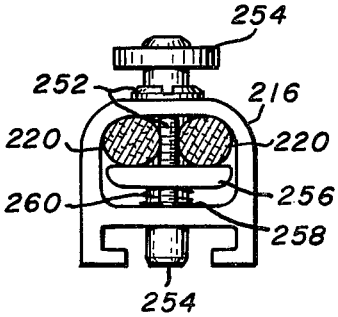
FIG. 12 is an end view of an adjustable rope-holding member of FIG. 10.
Figure 11:
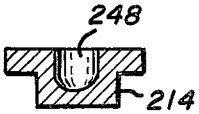
FIG. 11 is an end view of the T-bracket of FIG. 10.

The means by which the second alternate embodiment 210 is fastened within the frame 212 are illustrated in FIGS. 10, 11 and 12. FIG. 10 is a front view of a "T" bracket 214 and of the adjustable rope holder 216 which fits upon it. "T" bracket 214, seen in end view in FIG. 11, is a structural metal bracket of any desired length. At various points along the outer front surface of "T" bracket 214 and aligned linearally thereon are a number of positioning holes 248. Each positioning hole 248 represents a stop point wherein the adjustable rope holder 216 may be held in position. "T" bracket 214 further includes a number of mounting holes 250. Mounting holes 250 provide the means by which "T" bracket 214 may be firmly mounted to the frame 212.

Adjustable rope holder 216 is slidably mounted in "T" bracket 214. As illustrated in the side views of FIG. 11 and FIG. 12, the adjustable rope holder 216 is shaped such that it slides easily but firmly on the "T" bracket 214. The top or outer surface of adjustable rope holder 216 includes a tightening screw 252 and a positioning pin 254.

The function of the various elements of the adjusting bracket 216 is best illustrated by the side view of FIG. 12. It may be seen that tightening screw 252 extends through the top surface of rope holder 216 and through a tightening bar 256. Tightening screw 252 does not continue downwards through rope holder 216 to intersect the area which slides upon "T" bracket 214. The turning of tightening screw 252 causes tightening bar 256 to move upward or downward within adjusting bracket 216, depending on the direction of turning. This operation holds the end of rope 220 firmly in place. Rope 220 is threaded into adjustable rope holder 216 such that it enters from the near end as shown in FIG. 12, passes around tightening screw 252 and re-exits out the same end. Tightening screw 252 is then turned such that tightening bar 256 firmly holds the rope against the top interior surface of adjustable rope holder 216. This firmly holds the end of the rope 220 in place without requiring such techniques as splicing the rope to itself. This method further allows the adjustment of the tension on the device by allowing the user to pull an excess amount of rope through the adjustable rope holder 216 before tightening the screw 252. This method of bonding will act at any point upon the rope.

The other main operative element of the adjustable rope holding member 216 is positioning pin 252 which extends through the entire adjustable rope holder 216 into the area which slides over "T" bracket 214. Ordinarily positioning pin 252 is held downward such that it will extend downward into positioning hole 248 upon "T" bracket 214 and thus be held in position as shown in FIGS. 6 and 10. This is true because positioning pin 252 is provided with a ridge 258 and a compression spring 260 which bias the pin downward. The force of compression spring 260 upon ridge 258 may be counteracted by physical upward pulling upon positioning pin 254, thus freeing the adjustable rope holder 216 to move along "T" bracket 214. In this manner the adjustable rope holder 216 may be moved from one positioning hole 248 to another and the tautness of the rope 220 may be thereby adjusted.

The pulley brackets 218, shown in FIG. 6 are selected so as to mate with "T" brackets 214 in a manner similar to that of the adjustable rope holders 216.

FIGS. 13, 14, 15, and 16 illustrate a further alternate embodiment of exercise bar assembly referred to by the general reference character 322. The exercise bar assembly 322 is adaptable for use with any of the embodiments described.

Figure 13:
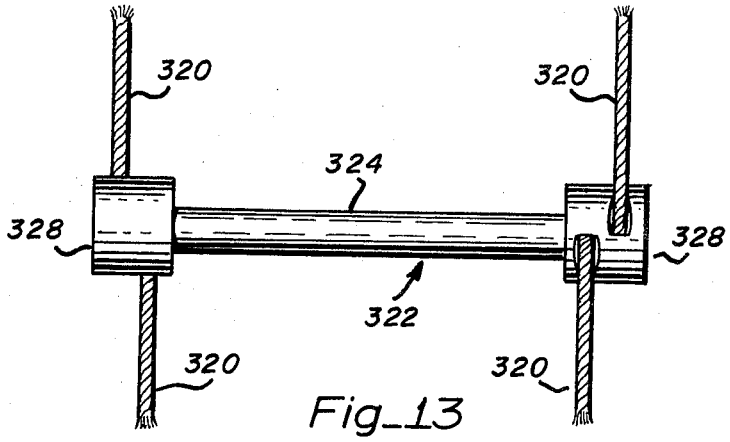
FIG. 13 is a front plan view of a further alternate exercise bar.

As illustrated in FIG. 13, alternate exercise bar assembly 322 includes a grasping bar 324 and a pair of rotating guide hubs 328 which receive the rope 320 on each end of the grasping bar. The rope 320 exits the bar assembly 322 on the same end as it entered.

Figure 14:
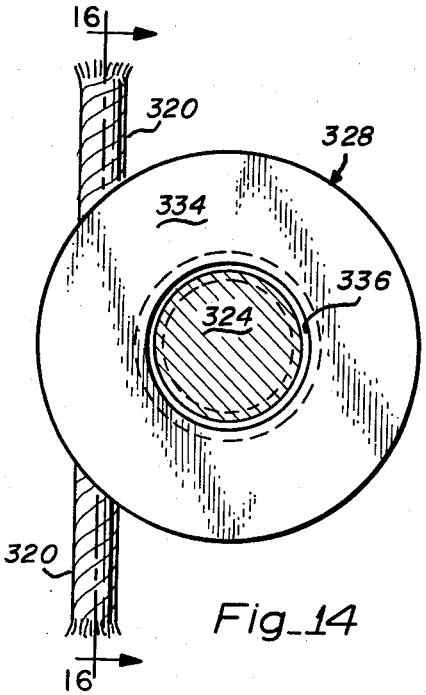
FIG. 14 is an end view of the exercise bar assembly of FIG. 13.
Figure 15:
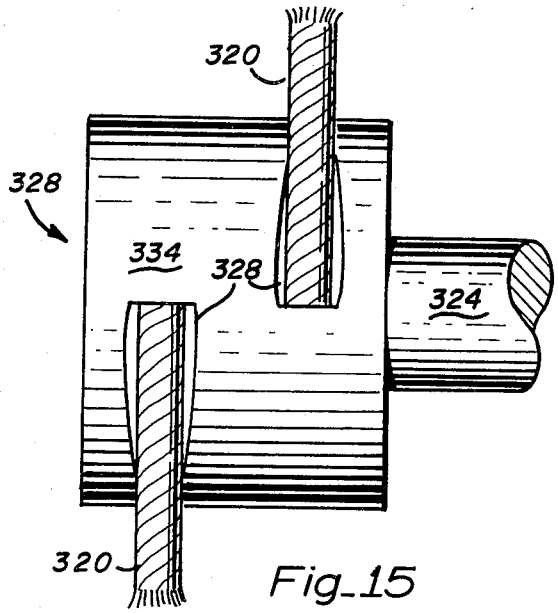
FIG. 15 is a front plan view of the rotating guide hub of FIG. 13.

FIG. 14 illustrates an end view of one of the rotating guide hubs 328. The grasping bar 324 extends through the rotating guide hub 328 so as to be visible from the exterior. The guide hub 328 itself includes an outer shell 334 and an inner shell 336 nestled within the outer shell 334. As illustrated in FIG. 15, outer shell 334 receives rope 320 through a pair of tapered apertures 338. Apertures 338 are tapered in such a manner that the rope does not catch or be abraded upon the aperture surface as it extends upward and downward from the exercise bar assembly 322.

Figure 16:
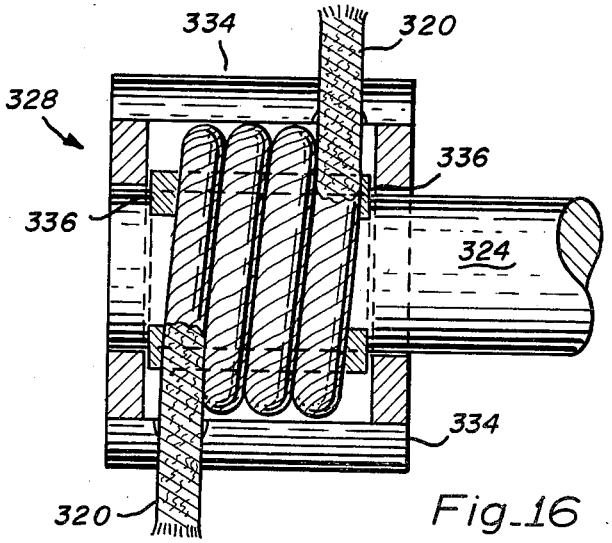
FIG. 16 is a cross-sectional view taken along the line 16—16 of FIG. 14.

FIG. 16 is a cross-sectional view of the rotating guide hub 328 showing the interrelationship between the rope 320, the grasping bar 324, the inner shell 336, and the outer shell 334 of the hub 328. In this figure it may be seen that the rope 320 enters the outer shell 334 through aperture 338, as shown in FIG. 15, and wraps a number of half-turns about inner shell 336. Inner shell 336 is a cylindrical member having an interior diameter slightly greater than the exterior diameter of grasping bar 324. Inner shell 336 is fixed upon grasping bar 324. The friction is created by the interaction between the rope 320 and the inner shell 336. The free spinning relationship between rotating guide hub 328 and the grasping bar 324 is valuable in that it is useful to have the grasping bar 324 rotate relative to the plane of ropes 320 for proper alignment during various exercises. It is easier to have the bar itself rotate slightly than to require the user to rotate his hands about the bar.

Most weight lifting type of exercises and similar pursuits may be duplicated using the mono-kinetic exerciser of the present invention. The various press type of lifts may be performed using the orientations illustrated in FIGS. 1, 5 and 6, whereas inverting the elements will allow such exercises as pullups or rowing.

The devices of the present invention are to certain degree unidirectional in that the force required to move the exercise bar assembly towards the springs, or other tensioning members is much greater than that required to reverse the direction. However, even in the reverse direction a significant amount of force is required to overcome the friction. Thus the return movement, while much easier than the initial direction, provides some exercise as well.

It has been found that a strong material such as a structural metal is particularly useful for the grasping bar and attachment bracket portions of the assembly. Various other elements may be of structural plastic or other materials. The rope selected should be a type which is not likely to catch on irregularities or to fray easily. A nylon interweave has been found to perform satisfactorily. The frictional force and the resulting adjustments are greatly affected by the type of rope selected.

Although the present invention has been described above in terms of the presently preferred embodiments, it is to understood that such disclosure is not to be considered as limiting. Accordingly, it is intended that the appended claims be interpreted as covering all alterations and modifications as fall within the true spirit and scope of the invention.

What is claimed is:

1. An exercise device for mounting within a generally rectangular frame comprising:

a first elongated rope member extending in the plane of the frame;

a second elongated rope member extending within the plane of the frame;

fastening means for securely and rigidly fastening one end of the first and one end of the second rope member at opposite points within the frame with respect to the major axis of the frame;

support means for supporting the remote portions of the first and second elongated rope members at positions within the frame displaced in the direction of the major axis from the fastening means;

an exercise bar assembly slidably mounted upon the first elongated rope member and the second elongated rope member so as to provide frictional resistance to movement of said assembly at points on said rope members intermediate the fastening means and the support means said exercise bar assembly being substantially perpendi-cular to the major axis of the frame during an exercise; and tensioning means for tensioning said rope members, said tensioning means being attached to the first elongated rope member and second elongated rope member such that the exercise bar assembly is intermediate the tensioning means and the fastening means.

2. An exercise device as recited in claim 1 wherein, the fastening means further comprise a lower support bar member member, said lower support bar member extending across the frame so as to be firmly held in position by the interaction of the frame with the ends of said lower support bar member.

3. An exercise device as recited in claim 2 wherein, said lower support bar includes a pair of over-lapping members which are elastically outwardly biased.

4. An exercise device as recited in claim 3 wherein, said lower support bar member includes a pair of mounting brackets for attaching to the frame, the outward ends of said overlapping members mating with said mounting brackets.

5. An exercise device as recited in claim 4 wherein, an outward end of at least one of said overlapping members includes a series of circumferential slots and the respective said mounting bracket includes a detent pin adapted to engage a selected one of said slots so as to maintain said lower support bar in a selected rotational orientation with respect to said mounting bracket.

6. An exercise device as recited in claim 1 wherein, the fastening means further include a pair of screw type hooks firmly mounted to the frame.

7. An exercise device as recited in claim 1 wherein, the fastening means further include a pair of elongated "T" brackets longitudinally mounted at opposing positions within the frame and a pair of respective adjustable rope holding members adapted to mate with said "T" brackets.

8. An exercise device as recited in claim 7 wherein, each said "T" bracket includes a plurality of positioning holes spaced longitudinally along its length and each said adjustable rope holding member is adapted to be firmly held in position on said "T" bracket by mating with any one of said positioning holes.

9. An exercise device as recited in claim 8 wherein, each said adjustable rope holding members includes a formed body adapted for mating with one of said "T" bars, a tightening screw extending partially therethrough, a tightening bar attached to said tightening screw for firmly holding a length of rope between said tightening bar and an interior surface of said formed body and an elastically biased positioning pin for mating with one of said positioning holes.

10. An exercise device as recited in claim 1 wherein, the support means further include an upper support bar extending across the frame.

11. An exercise device as recited in claim 10 wherein, the tensioning means include a first extension spring depending from said upper support bar to engage the upper end of the first elongated rope member and a second extension spring, substantially similar to said first extension spring, depending from said upper support bar to engage the upper end of the second elongated rope member.

12. An exercise device as recited in claim 1 wherein, the support means further includes a pair of screw type hooks firmly mounted to the opposite side frame and a pair of respective pulleys depending therefrom for receiving the elongated rope means.

13. An exercise device as recited in claim 12 or 15 wherein, the tensioning means include an adjustable expansion member connecting the ends of the first and second elongated rope members at a position between said pulleys.

14. An exercise device as recited in claim 12 or 15 wherein, the tensioning means include an extension spring connecting the ends of the first and second elongated rope members at a position between said pulleys.

15. An exercise device as recited in claim 1 wherein, the support means further include a pair of "T" brackets longitudinally mounted at opposite positions within said frame and a pair of respective pulley brackets, including pulleys therein, adapted to receive the elongated rope members and said pulley brackets are further adapted to mate with said "T" brackets to be firmly positioned thereon.

16. An exercise device as recited in claim 1 wherein, the exercise bar assembly further includes a grasping bar having rope receiving members at each end thereof.

17. An exercise device as recited in claim 16 wherein, each said rope receiving member is a cylindrical member including a first diametrical bore and a parallel second diametrical bore longitudinally displaced from said first bore such that the respective elongated rope member passes through said first bore, wraps an odd number of one-half turns about said rope receiving member and then passes through said second bore.

18. An exercise device as recited in claim 16 wherein, each said rope receiving member includes an inner cylindrical shell mounted on said grasping bar and an outer cylindrical shell rotatably surrounding said inner shell, said outer shell including a pair of tapered apertures on opposite sides of said outer shell and longitudinally displaced from each other for receiving the respective elongated rope member, the elongated rope member entering through one of said apertures in said outer cylindrical shell wrapping an odd number of one-half turns about said inner cylindrical shell and exiting through said other aperture in said outer cylindrical shell.

19. An exercise device as recited in claim 1 wherein, the exercise bar assembly further includes an outer grasping bar cylinder, an inner grasping bar cylinder nested within said outer grasping bar cylinder, a pair of collar members situated about the ends of said inner cylinder, a pair of rope guide members respectively secured to said collar members and a friction rod axially extending within said inner grasping bar cylinder and between said rope guide members.

20. An exercise device as recited in claim 19 wherein, each said collar member is a cylindrical ring including an annular depression about its outer side surface for receiving a circumferential ridge about the end of said inner grasping bar cylinder;

each said rope guide member is a cylindrical member including a pair of rope receiving apertures extending axially therethrough so as to be symmetrically arrayed about the axis of the rope guide member, the area immediately about the entrance to said rope receiving apertures being tapered to smoothly receive a rope, and a seating hole extending partially into said rope guide member about said axis on the inner side of said rope guide member for receiving an end of said friction rod; and said friction rod is a cylindrical rod, tapered at the ends to fit snugly into said seating holes, about which the rope members intertwine to pass through the exercise bar assembly from one end to another, the interaction between the elongated rope members and said friction rod providing an amount of frictional resistance to movement of the exercise bar assembly on the elongated rope members.

21. An exercise device as recited in claim 1 wherein, the fastening means further include a pair of elongated "T" brackets longitudinally mounted at opposing positions to said frame and a pair of respective adjustable rope holding members adapted to mate with said "T" brackets, each said "T" bracket including a plurality of positioning holes spaced longitudinally along its length and each said adjustable rope holding member is adapted to be firmly held in position on said "T" bracket by mating with any one of said positioning holes, each said adjustable rope holding members comprising a formed body adapted for mating with one of said "T" bars, a tightening screw extending partially therethrough, a tightening bar attached to said tightening screw for firmly holding a length of rope between said tightening bar and interior surface of said formed body and an elastically biased positioning pin for mating with one of said positioning holes;

the support means further comprise a pair of "T" brackets longitudinally mounted at opposing positions within said frame and a pair of respective pulley brackets including pulleys therein, adapted to receive the elongated rope members and said pulley brackets are further adapted to mate with said "T" brackets to be firmly positioned thereon;

the exercise bar assembly further comprises an outer grasping bar cylinder, an inner grasping bar cylinder nested within said outer grasping bar cylinder, a pair of collar members situated about the ends of said inner cylinder, a pair of rope guide members respectively secured to said collar members and a friction rod extending within said inner grasping bar cylinder and between said rope guide members, each said collar member is a cylindrical ring including a an annular depression about its outer side surface for receiving a circumferential ridge about the end of said inner grasping bar cylinder, each said rope guide member is a cylindrical member including a pair of rope receiving apertures extending axially therethrough so as to be symmetrical about the axis of the rope guide member, the area immediately about the entrance to said rope receiving apertures being tapered to smoothly receive a rope, and a seating hole extending partially into said rope guide member about said axis on the inner side of said rope guide member for receiving the end of said friction rod, said friction rod is a cylindrical rod, tapered at the ends to fit snugly into said seating holes, about which the rope members intertwine to pass through the exercise bar assembly from one end to another, the interaction between the elongated rope members and said friction rod providing an amount of frictional resistance to movement of the exercise bar assembly on the elongated rope members; and the tensioning means includes an extension spring connecting the ends of the first and second elongated rope members at a position between said pulleys.

* * * * *